United States Patent [19]

Ebata et al.

[11] Patent Number: 4,975,744

[45] Date of Patent: Dec. 4, 1990

[54] IMAGE BEARING MEMBER AND DRIVING MECHANISM THEREFOR

[75] Inventors: Tokihide Ebata, Tana; Shigeyoshi Onoda, Yokohama, both of Japan

[73] Assignee: Canon Kabushiki Kaisha, Tokyo, Japan

[21] Appl. No.: 440,424

[22] Filed: Nov. 21, 1989

Related U.S. Application Data

[63] Continuation of Ser. No. 330,377, Mar. 29, 1989, abandoned, which is a continuation of Ser. No. 212,087, Jun. 27, 1988, which is a continuation of Ser. No. 906,040, Sep. 10, 1986, abandoned.

[30] Foreign Application Priority Data

Sep. 17, 1985 [JP] Japan ..... 60-204951
Sep. 17, 1985 [JP] Japan ..... 60-205102

[51] Int. Cl.[5] ..... G03G 15/00
[52] U.S. Cl. ..... 355/211; 355/200
[58] Field of Search ..... 355/211, 210, 200, 133; 29/123; 101/375, 378

[56] References Cited

U.S. PATENT DOCUMENTS

| | | | |
|---|---|---|---|
| 4,345,834 | 8/1982 | Kimura et al. | 355/3 DR |
| 4,427,883 | 7/1985 | Kamiyama . | |
| 4,449,809 | 5/1985 | Tamura | 355/3 DR |
| 4,530,588 | 7/1985 | Kimura et al. | 355/3 DR |
| 4,561,763 | 12/1985 | Basch | 355/3 R |
| 4,591,258 | 5/1986 | Nishino et al. | 355/3 R |
| 4,714,337 | 12/1987 | Nishino et al. | 355/200 |

FOREIGN PATENT DOCUMENTS

| | | |
|---|---|---|
| 0115315 | 8/1984 | European Pat. Off. . |
| 136902 | 4/1985 | European Pat. Off. . |
| 112261 | 7/1985 | Japan . |
| 454213 | 9/1936 | United Kingdom . |
| 1490770 | 11/1977 | United Kingdom . |

*Primary Examiner*—R. L. Moses
*Attorney, Agent, or Firm*—Fitzpatrick, Cella, Harper & Scinto

[57] ABSTRACT

The improvement is in the driving mechanism and positioning mechanism between an image bearing member and a main assembly of an image forming apparatus using the image bearing member. The image bearing member has a shaft receiving portion adjacent the center thereof to receive a positioning shaft of the main assembly when the image bearing member is mounted in said main assembly. By the receiving engagement, the image bearing member is correctly positioned with respect to the main assembly. The image bearing member is also provided with a driving force receiving portion where the image bearing member is engaged with a driving member of the main assembly so that the image bearing member can be driven from the main assembly. In such an arrangement, the shaft receiving portion and the driving force receiving portion are radially overlapped, at least in part, with each other as seen from a rotational axis of the image bearing member.

18 Claims, 9 Drawing Sheets

IMAGE BEARING MEMBER AND DRIVING MECHANISM THEREFOR

This application is a continuation of application Ser. No. 07/330/377 filed Mar. 29, 1989, now abandoned, which in turn is a continuation of U.S. Ser. No. 07/212,087 filed June 27, 1988, which is a continuation of U.S. Ser. No. 06/906,040 filed Sept. 10, 1986, now abandoned.

FIELD OF THE INVENTION AND RELATED ART

The present invention relates to an image bearing member usable with an electrophotography or another image forming process, and a driving mechanism for the image bearing member. This invention also relates to an image forming apparatus using the image bearing member and/or the driving mechanism.

Also, the present invention relates to a process unit which contains as a unit an image bearing member such as a photosensitive drum or belt or an insulating drum or belt and at least one of processing means actable on the image bearing member to form repeatedly an image on the photosensitive member, such as a charger, a developing device, a transfer charger, a cleaning device or the like, the process unit being detachably mountable into a main assembly of the image forming apparatus. Further, the present invention relates to an image forming apparatus such as an electrophotographic copying machine or recording machine using the process cartridge.

An electrophotographic copying machine or printer using such a process unit or cartridge is known as disclosed in U.S. Pat. Nos. 3,985,436; 4,286,861; 4,470,689; 4,551,000; 4,575,221; and 4,591,258. The structures of the known process cartridge will be briefly explained in conjunction with FIGS. 9 and 10.

FIG. 9 is a perspective view illustrating the connecting potion between the cartridge and the main assembly of the image forming apparatus.

FIG. 10 is a sectional view illustrating the connecting portion between the cartridge and the main assembly of the apparatus. Within a cartridge housing *7a*, there are contained a developing device, a cleaning device and other means (process means) together with a photosensitive drum 4. The detailed explanation is omitted in this respect, since they are known.

At that side of the cartridge housing which is engaged with the main assembly, there are exposed externally a cartridge shaft 5*a* into which a part of the photosensitive drum 4*a* is reformed, and a drive transmission gear 6*a* fixedly mounted on the shaft 5*a*. A part of the gear 6*a* is formed into ribs 6*c* for receiving a driving pin 3*b* of the main assembly. On the other hand, the photosensitive drum 4*a* is supported in the housing 7*a* with the cartridge supporting portion 6*b* rotatably supported in the housing 7*a*.

The main assembly is provided with a drum driving gear 3*a* which is rotatably supported in a bearing 2*a* fixed to a frame 1*b*. The driving gear 3*a* is driven by an unshown driving means and is provided with the driving pin 3*b* which is movable in the leftward and rightward directions in this Figure and which is normally biased toward the cartridge.

When the cartridge is inserted in the direction indicated by an arrow to mount the cartridge in place in the apparatus, the cartridge shaft 5*a* is engaged with the bearing 2*a* of the main assembly, whereby the cartridge is correctly positioned with respect to the main assembly. Then, the drum driving gear 3*a* rotates, the driving pin 3*b* driven with the gear 3*a* is brought into engagement with a rib 6*c* of the cartridge, and the further rotation of the gear 3*a* rotates the photosensitive drum 4*a*.

The described structure is effective to reduce the size of the cartridge. However, in the case where the diameter of the photosensitive drum is reduced, or where the length of the drum is increased in comparison with the diameter of the photosensitive drum, an undesirably bias force is exerted to the photosensitive drum since then the position where the drum 4*a* is supported and the position where the driving force is transmitted to the drum are apart in the direction of the rotational axis thereof. This results in vibration of the photosensitive drum 4*a* or obstructions to a smooth rotation of the photosensitive drum 4*a*.

SUMMARY OF THE INVENTION

Accordingly, it is a principal object of the present invention to provide a drive transmission and/or positioning mechanism which is suitable to an image bearing member when it is reduced in its diameter and/or when it is increased in its length.

It is another object of the present invention to provide a drive transmitting and/or positioning mechanism for an image bearing member which is reduced in its thickness.

It is a further object of the present invention to provide a process unit or cartridge utilizing the drive transmitting and/or positioning mechanism.

It is a further object of the present invention to provide a process cartridge which is not provided with the cartridge shaft 5*a* of the photosensitive drum 4 employed in the prior art described hereinbefore, and in which various means for the necessary functions are packed in the width or length of the drum, whereby the process cartridge is sufficiently protected even when it inadvertently hits another member.

It is a further object of the present invention to provide a process cartridge which can utilize a flange of an insulating material such as resin together with the reduction of the diameter of the photosensitive drum, whereby the weight of the cartridge is further reduced.

According to an embodiment of the present invention, there is provided an image bearing member having an image bearing surface detachably mountable into an image forming apparatus, comprising a positioning portion, disposed adjacent an end of said image bearing member, for engagement with a rotational center positioning member of the image forming apparatus when said image bearing member is mounted into the image forming apparatus; and a driving force receiving portion, for receiving a driving force for rotating said image bearing member, said driving force receiving portion being radially overlapped, at least in part, with said positioning portion.

In another aspect of the present invention, the above structure is incorporated in the image bearing member so that the image bearing member is positioned in and driven by the main assembly of the image forming apparatus.

The image bearing member may be in the form of a photosensitive drum comprising a conductive base and an electrophotographic photosensitive layer thereon or in the form of an insulating drum comprising an insulating or dielectric layer, or may be a combination of such an image bearing member in the form of a belt and a roller or rollers for supporting such a belt.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to FIGS. 1, 2, 3 and 4, structures of an image bearing member, a process cartridge and the main assembly, according to an embodiment of the present invention, will be described.

Figure 4:
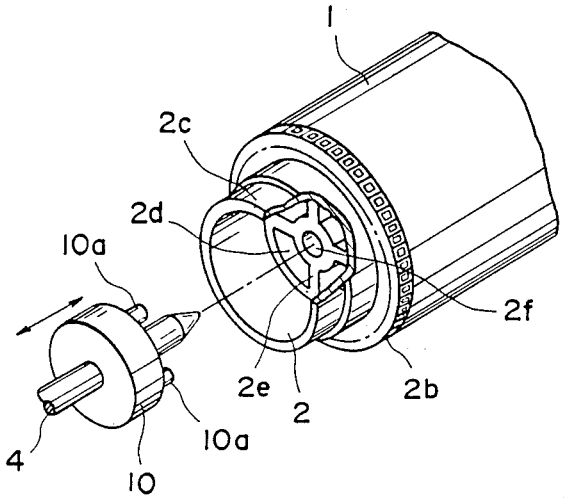

The process cartridge comprises a photosensitive drum or cylinder 1, a flange 2 and a cartridge housing 3 containing the photosensitive drum 1. The flange 2 is fixedly mounted to the photosensitive drum 1 adjacent a longitudinal end of the photosensitive drum 1 and is provided with a gear portion **2*b* for driving an internal mechanism in the process cartridge, an engaging portion for rotational engagement with the cartridge housing 3 and a positioning portion 2*f* for receiving a driving shaft 4 of the main assembly. The positioning portion 2*f* is formed at the center of the flange 2. The flange 2 is made of resin material such as polyacetal resin or polycarbonate resin. The cartridge housing 3 has a drum supporting portion 3*a* for receiving the engaging portion 2*c* of the flange 2. In this embodiment, the photosensitive drum 1 is formed by an aluminum cylinder having a diameter of 30 mm. When the positioning portion 2*f* receives the shaft 4, the process cartridge and the photosensitive drum 1 are correctly positioned relative to the main assembly. The shaft 4 is rotatably supported on a side plate 7 of the main assembly by a spring receiving and bearing member 5 and a bearing 6. And shaft is driven by a chain-sprocket mechanism 8. A drive transmission element 10 for transmitting the driving force of the driving shaft 4 to the drum 1 is mounted on the driving shaft 4 for longitudinal sliding movement only, that is, the drive transmission element 10 is slidable in the longitudinal direction but not rotatable with respect to the shaft 4. The drive transmission element is normally urged by a coil spring 12 toward the drum 1. The driving transmission element 10 is provided with one or more projections 10*a* which are engageable with a receiving portion or portions 2*d* formed in the flange 2, as best seen in FIG. 4. By this engagement, the drum 1 is rotationally driven. To an inside of the drum, a conductive plate is strongly fixed. The conductive plate 13 is of steel, copper, stainless steel or phosphor bronze. When the cartridge is mounted into the main assembly in place, the driving shaft 4 which is also conductive is contacted to a spring portion 13*a* into which a part of the conductive plate 13** is formed, so that the electrical connection is established therebetween.

Figure 1:
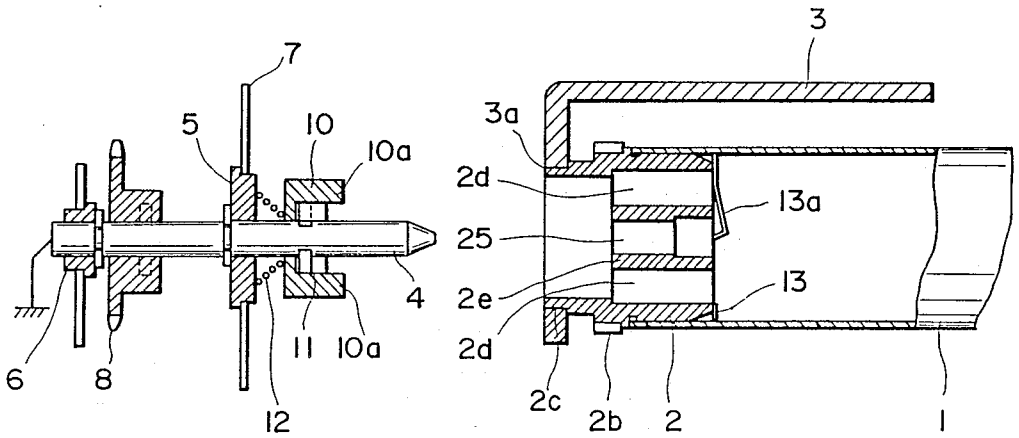
FIGS. 1 and 2 are sectional views of a part of a process cartridge and a part of the main assembly, using an image bearing member according to an embodiment of the present invention.
Figure 2:
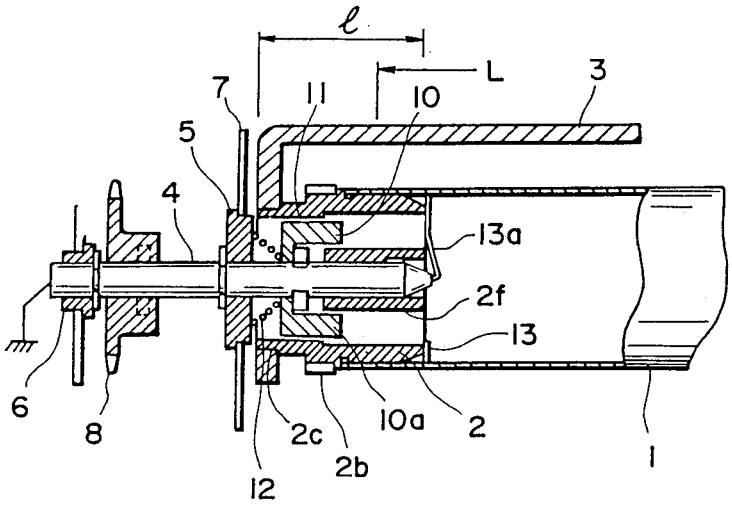
Figure 3:
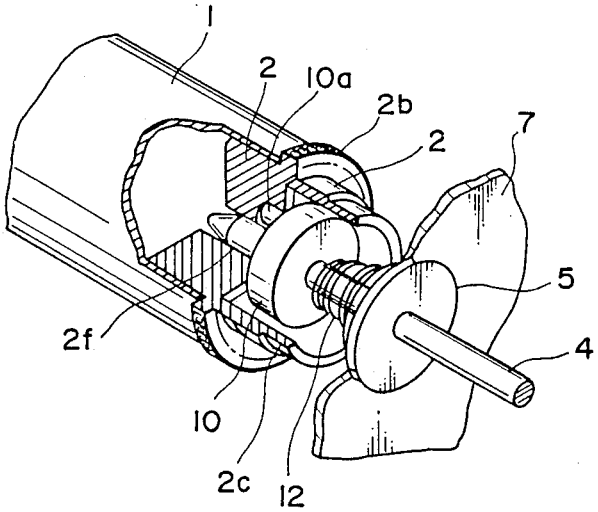
FIGS. 3, 4 and 5 are partly broken perspective views illustrating the connection between the cartridge and the main assembly.

When the cartridge is mounted into the main assembly, a free end of the driving shaft 4 which also functions as a positioning member is inserted into the positioning portion **2*f* of the flange 2 so that the rotational center of the photosensitive drum 1 is aligned with the driving shaft 4 of the main assembly. Then, the cartridge is further pushed into the main assembly, and the projected portion 10*a* of the drive transmitting element 10 is brought into the drive receiving portion 2*d* of the flange 2, by which the engagement between the driving shaft 4 and the drum 1 is completed. It is possible that the projected portion 10*a* and the receiving portion 2*d* are not aligned. In that case, the free end of the projection 10*a* is engaged to the surface 2*e*, and the drive transmission element is pushed leftwardly as seen in FIGS. 1 and 2. When, however, the driving shaft 4 rotates, they are sooner or later brought into alignment, and then, the drive transmission element 10 is pushed toward the process cartridge by the action of the coil spring 12, so that they are engaged properly. In this state, the photosensitive drum is rotatable by the driving force from the main assembly with the photosensitive drum being electrically grounded. This engaged state is shown in FIG. 2. In FIG. 3**, the process cartridge and the main assembly are shown in the state of being engaged in a perspective view.

In FIG. 4, the relation between the driving shaft 4 with the transmission element 10 and the flange 2 with the positioning portion **2*f* and the drive receiving portion 2*d***, in a perspective view under the condition that they are being engaged.

Figure 5:
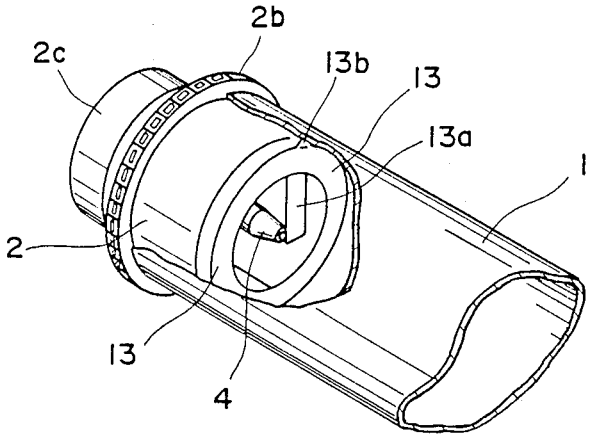

In FIG. 5, the electrical contact between the shaft 4 and the conductive plate 13 is illustrated in a perspective view. As will be understood, the conductive plate 13 has a projection **13*b* by which it is securedly fixed to the inside surface of the drum 1**.

Figure 6:
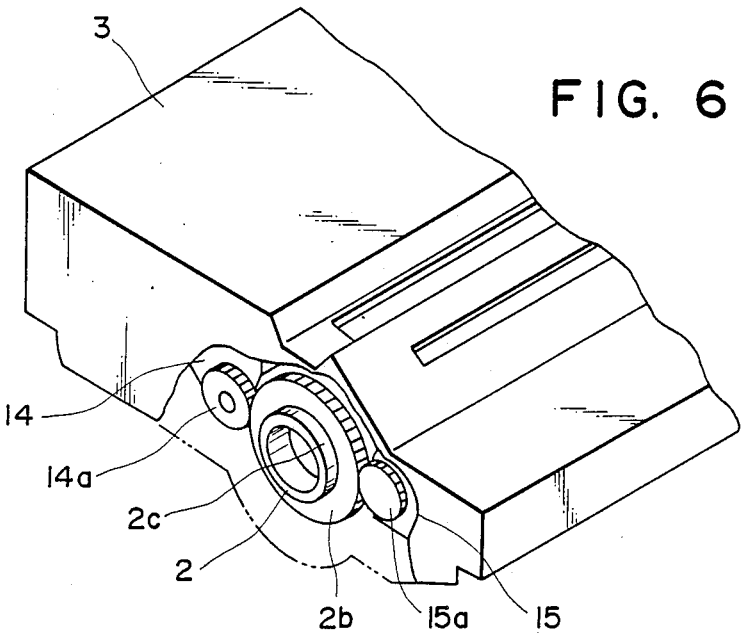
FIGS. 6 and 7 are perspective views of the cartridge according to the embodiment of the present invention.
Figure 7:
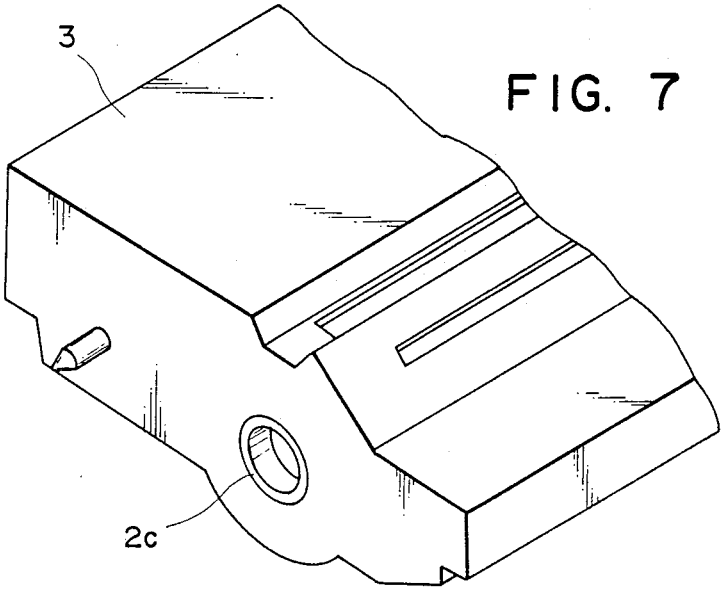

Referring to FIG. 6, the gear portion **2*b* is meshed with a gear 14 for transmitting the driving force to rotate a developing sleeve of a developing device 14 which is contained in the cartridge as a unit and also is meshed with a gear 15*a* for transmitting a driving force to rotate a screw which serves to forcedly convey the toner collected by a cleaning device 15** also contained in the cartridge as a unit.

Since the driving force is transmitted to those mans from the flange 2 through the gear portion **2*b*, the load resulting from the required drive transmission, tends to cause and increase an eccentricity of the flange 2 with respect to the drive shaft 4**.

However, as in this embodiment of the present invention, at least a part of the positioning portion 2*f* of the flange 2 where the shaft 4 and the flange 2 are engaged, is radially overlapped with at least a part of the drive receiving portion 2*d* of the flange 2 where the driving projection 10*a* is engaged with the flange 2. Because of this positional relation, even if a force or forces are exerted to the drive receiving portion 2*d* which is away from the rotational center, it is possible to stably drive and rotate the photosensitive drum 1.

Further, in this embodiment the flange 2 is provided with the gear portion 2*b* for driving other means, and at least a part of the gear portion 2*b* is radially overlapped with at least a portion of the positioning portion 2*f*. Here, "radially overlapped" means that they are overlapped when seen from the rotational axis in a direction perpendicular to the rotational axis.

Because of this positional relation between the gear portion 2*b* and the positioning portion 2*f*, the possible eccentricity of the gear portion 2*b* and/or the photosensitive drum 1 is minimized even when the gear portion 2*b* receives an eccentric high load.

In another aspect of the present embodiment, the drive transmitting action from the main assembly to the process cartridge is carried out within the range of the length, that is, width of the photosensitive drum 1. For this reason, the photosensitive drum partly exposed from the cartridge housing 3 does not have a central shaft projected out of the photosensitive drum for the purpose of positioning, as contrasted to the conventional process cartridge. Additionally, the flange having a relatively complicated configuration to receive the driving force is not exposed very much. Therefore, the positioning portion or the drive receiving portion which is an important part of the process cartridge from the standpoint of the driving connection with the main assembly is not damaged or deformed even when the process cartridge is handled without care.

From a further aspect of the drive transmitting mechanism according to this embodiment, the resin flange 2 which functions to receive the driving force to the drum 1, extends from the housing 3 thereinto by a distance l, as shown in FIG. 2. Further, when the cartridge is mounted in to the main assembly, the shaft 4 extends into the housing to such an extent that it extends into the imaging area L of the drum 1.

Because of this arrangement, that region of the photosensitive drum 1 which is effective for the image formation is partly used as the region for the drive transmitting mechanism and/or the electrical contact establishing region, whereby the total length of the photosensitive drum assembly is reduced as compared with the conventional ones. As a result, the size of the photosensitive drum and/or the process cartridge can be reduced, and also, the protection of the drive transmitting mechanism is assured.

Figure 8:
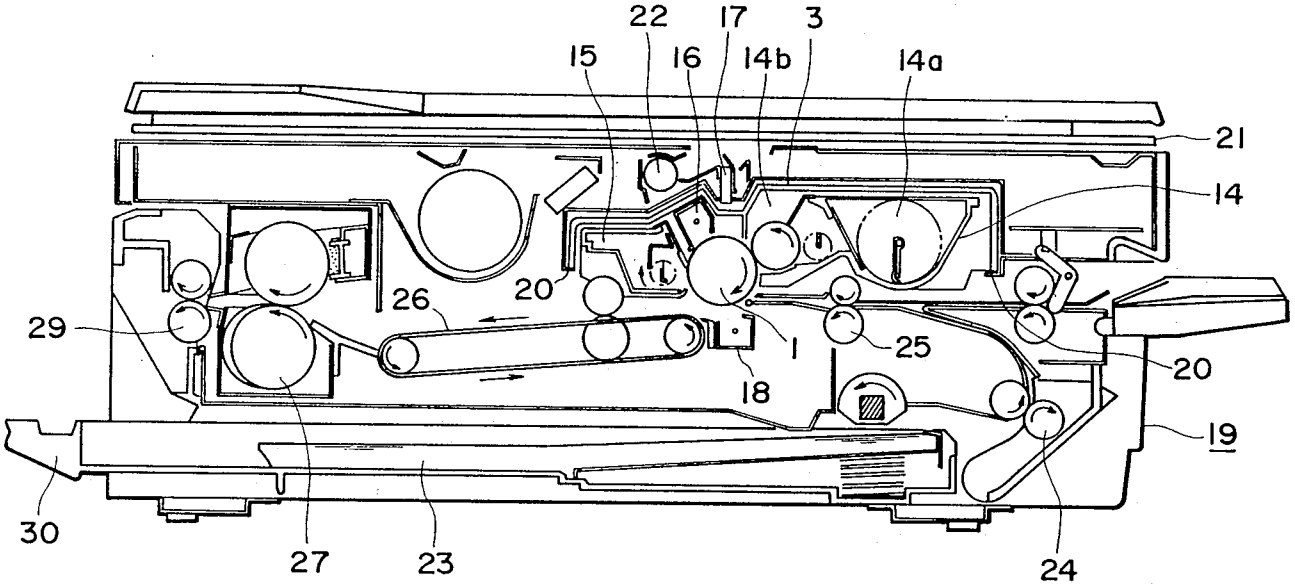
FIG. 8 is a sectional view of an electrophotographic copying machine using the cartridge according to an embodiment of the present invention.
Figure 9:
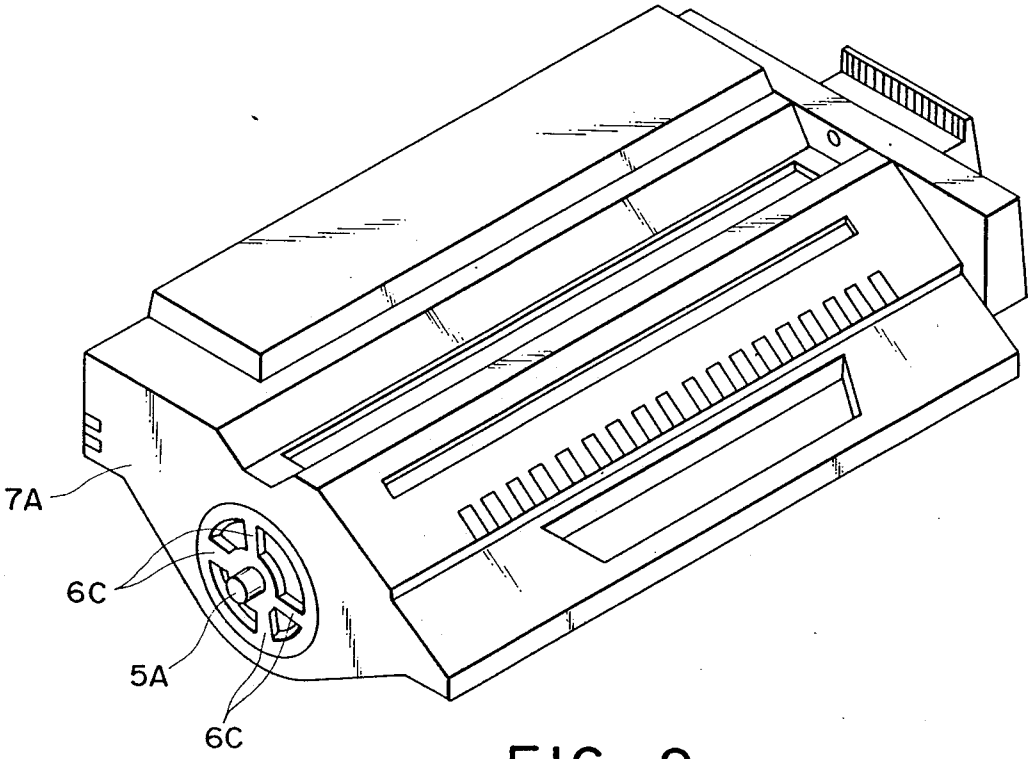
FIG. 9 is a perspective view of a conventional cartridge.
Figure 10:
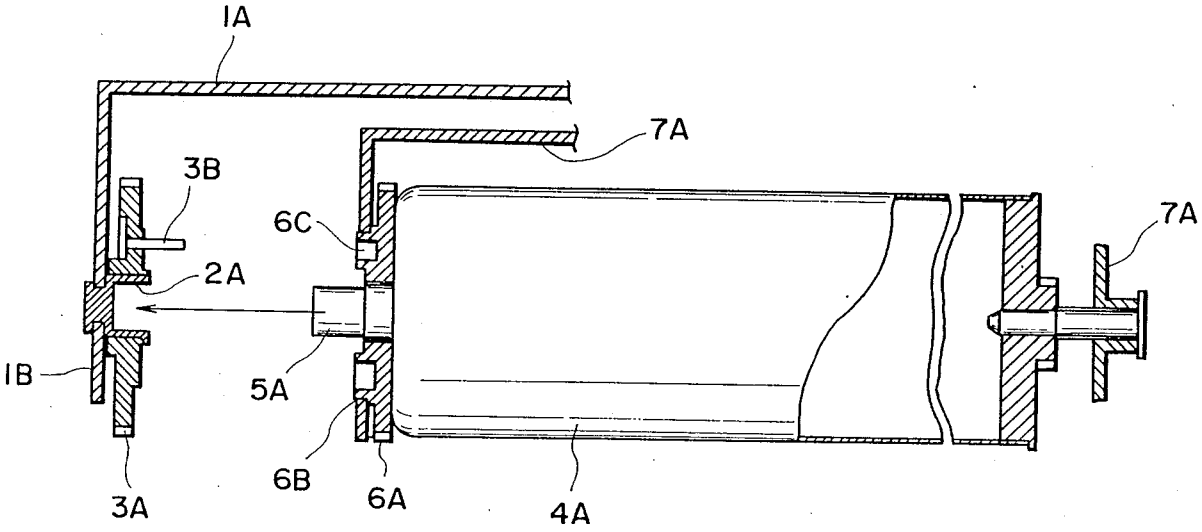
FIG. 10 is a sectional view illustrating a connection between the conventional cartridge and a main assembly of the image forming apparatus.

FIG. 8 illustrates an electrophotographic copying apparatus usable with the process cartridge according to the embodiment described above.

The copying apparatus 19 comprises a photosensitive drum 1 having a conductive base drum of aluminum coated with a photoconductive layer, which is rotatable in the direction indicated by an arrow. Around the drum 1, there are provided, in the direction of the rotation, a corona discharger 16, an array 17 of short-focus optical elements, a developing device 14, a transfer corona discharger 18 and a cleaning device 15. In this apparatus, the photosensitive drum 1, the discharger 16, the developing device 14 and the cleaning device 14 are contained in the housing 3 as a unit to constitute a process cartridge. The housing 3 is guided and supported by a guide rail 20 fixed to the main assembly of the electrophotographic copying apparatus. The process cartridge is detachably mountable into the main assembly.

The developing device 14 includes at an upper position a hopper 14*a* for containing developer, and also includes at a lower position a developing roller 14*b* which is effective to supply the developer to the photosensitive drum 2. The developer, in this embodiment, may be one component developer containing magnetic toner particles or two component developer containing toner particles and magnetic carrier particles. The developing roller 14*b* may be in the form of a rotatable magnetic roller having magnetic pole or poles in the surface thereof or may be a combination of a magnetic roller and a non-magnetic sleeve enclosing it. The cleaning device 15 may be in the form of a cleaning blade or a fur brush.

In operation, the surface of the photosensitive drum 1 is uniformly electrically charged by the corona discharger 16 to a predetermined polarity. On the other hand, an original to be copied is placed on an original carriage which is reciprocable in this embodiment and which is located at an upper part of the main assembly is illuminated by a lamp 22, and the light reflected by the original is projected onto the photosensitive drum 1 through the array 17 of the optical elements. By this exposure of the photosensitive drum 1 to the reflected image light, an electrostatic latent image is formed on the photosensitive drum. The thus formed latent image is developed by the developing device 14, and the developed image is transferred to a transfer material by the transfer corona discharger 18. The transfer material is manually loaded into a transfer material feeding cassette 23, from which the transfer material is fed out one by one with the aid of the transfer rollers 24 and timing roller 25 to between the photosensitive drum 1 and the transfer discharger 18. The transfer material having received the image from the photosensitive drum 1 is transported through a passage 26 to the image fixing device 27 where the transferred image is fixed. Then, the transfer material is discharged onto a tray 30 by a discharging roller couple 29.

In the foregoing embodiment, the shaft 4 has been described as functioning as a driving shaft as well as a positioning shaft. However, as the positioning shaft, it is not required that the shaft 4 is rotatable.

Figure 11:
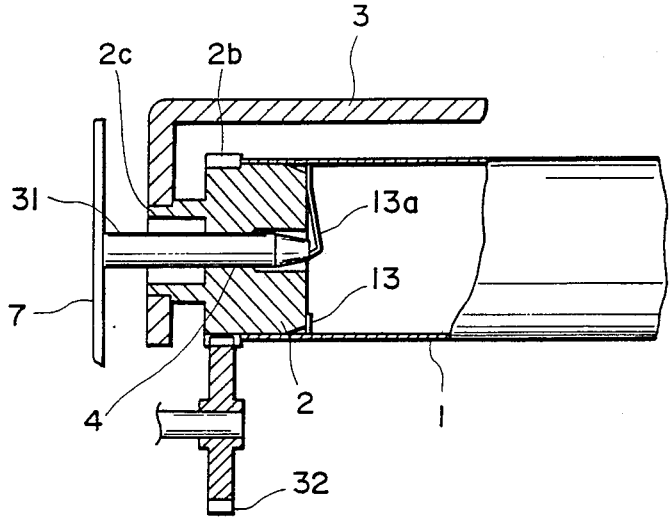
FIG. 11 is a sectional view of a part of a cartridge and a part of the main assembly according to another embodiment of the present invention.

FIG. 11 illustrates another embodiment of the present invention, wherein like reference numerals have been used to describe the corresponding elements. In this embodiment, the positioning portion 2*f* of the resin flange 2 receives a positioning shaft 31 which is fixedly mounted to a side plate or frame of the main assembly. In this Figure, the process cartridge is shown as having been mounted into the main assembly. In this state, the gear portion 2*b* of the flange 2 is meshed with a drum driving gear 32 of the main assembly, so that the rotation of the drum driving gear 32 drives the flange 2, and therefore, the photosensitive drum 1. It is possible that the gear portion 2*b* of the flange 2 is further meshed with other gears for driving another processing means within the process cartridge, as shown in FIG. 6.

Figure 12:
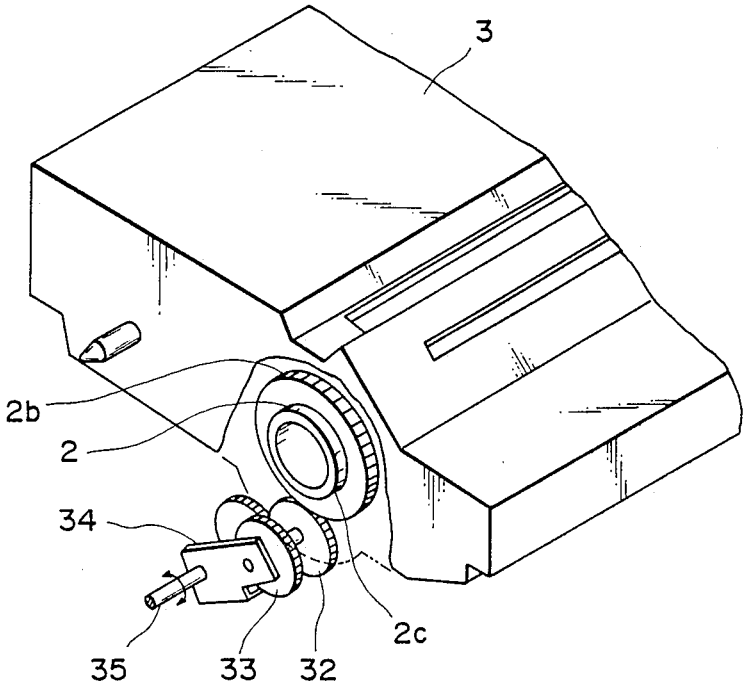
FIG. 12 is a partial perspective view of the cartridge of FIG. 11.

FIG. 12 illustrates the meshing engagement between the gear portion 2*b* of the flange 2 and the drum driving gear 32. The driving gear 32 is supported together with an additional gear 33 on a gear supporting plate 34. The supporting plate 34 is pivotably supported on a pin 35. By this structure, the driving gear 32 is capable of assuming a first position wherein it is meshed with the gear portion 2*b* and a second portion wherein it is away therefrom, in association with mounting an demounting of the process cartridge with respect to the main assembly.

It is understood that, in this embodiment, the positioning portion 2*f* where the positioning shaft 31 is engaged with the flange 2 is at least partly overlapped radially with the drum gear portion 2*b* where the drum gear portion 2*b* is externally driven, or the driving force is transmitted to a driving gear to another processing means in the cartridge.

Therefore, even when an eccentric external force is imparted to the photosensitive drum 1, the flange 2 is stably supported. Similar to the foregoing embodiment, the photosensitive drum assembly has fewer portions projecting out of the cartridge housing 3, and the portions used for the positioning and the drive transmission are protected sufficiently by the housing 3.

In this embodiment, the photosensitive drum assembly is constituted by a metal cylindrical member and a resin flange (for example, polycarbonate resin containing fluorine), and the drum positioning portion and the driving force receiving portion are radially overlapped. For this reason, no significant eccentric force is applied, and therefore, the latitude of selecting the flange material is increased.

In this embodiment, the same thing applies as in the embodiment of FIG. 2 with respect to the effective length of the drum 1 for the image formation and with respect to the distance l from the out side of the housing 3 to the end of the flange 2.

In the foregoing embodiments, the photosensitive drum 1 and the flange 2 are separate members integrally connected. However, it is possible that the photosensitive drum has an integrally molded flange 36.

Figure 13:
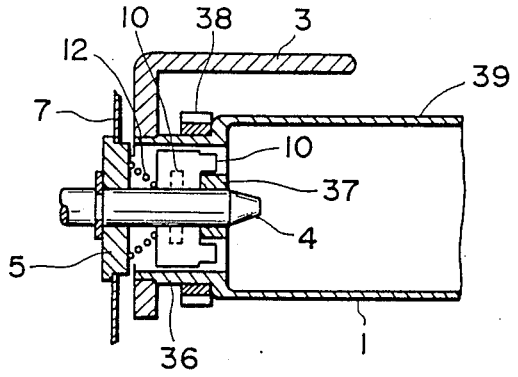
FIG. 13 is a sectional view of a part of a cartridge and a main assembly, according to a further embodiment of the present invention.
Figure 14:
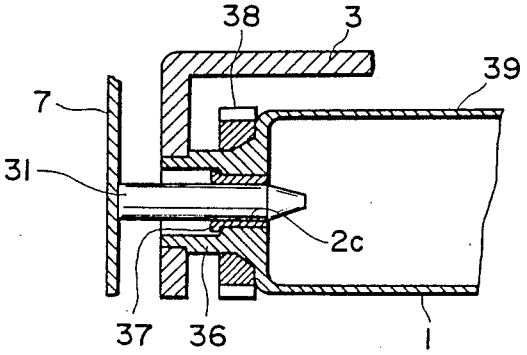
FIG. 14 is a sectional view of a part of a cartridge and a part of a main assembly according to a further embodiment of the present invention.

FIGS. 13 and 14 illustrate embodiments of this type, wherein like reference numerals have been used to designate the corresponding elements. In FIG. 13, the positioning and drive force transmitting mechanisms are similar to the embodiment of FIG. 1. The positioning and driving shaft 4 is engaged into a bearing portion 37 (a positioning portion) of the photosensitive drum 39. The gear 38 is fixed to the flange 36 by pressure fitting or bonding.

As will be understood from FIG. 13, the positional relations described in FIG. 1 embodiment apply to this embodiment.

In FIG. 14, the positioning and drive force receiving mechanisms are similar to those of the FIG. 11 embodiment. The drum 39, however, is similar to the FIG. 13 embodiment. In that it has a molded integral flange.

In the foregoing embodiment, the image bearing member has been in the form of a photosensitive drum. However, the image bearing member may be an insulating drum when the latent image is formed by modulated ions or multi-stylus electrodes.

As for the components constituting the process cartridge, the image bearing drum, the corona discharger, the developing device and the cleaning device have been described as being contained in the housing as a unit. However, it is possible that the process cartridge contains the image bearing drum and the discharger; the image bearing drum and the cleaning device; or the image bearing drum and the developing device. Further, another means of the main assembly may be contained in the housing to constitute a process cartridge.

As another example using a photosensitive drum or a process cartridge containing a photosensitive drum, there is a printer using a modulated laser beam in place of the light reflected by an original to be copied.

In the foregoing embodiments, the process cartridges have been described. However, the present invention is applicable to the photosensitive drum itself.

When the present invention is applied to the process cartridge, the present invention is also applicable to the developing roller and/or a cleaning roller when they receive a driving force from the main assembly independently from the driving force to the photosensitive drum.

In the foregoing embodiments, the photosensitive member in the form of a drum is directly drive. However, the present invention is applicable to a drum member, a cylindrical member or roller for driving a photosensitive member in the form of a belt trained therearound.

Figure 15:
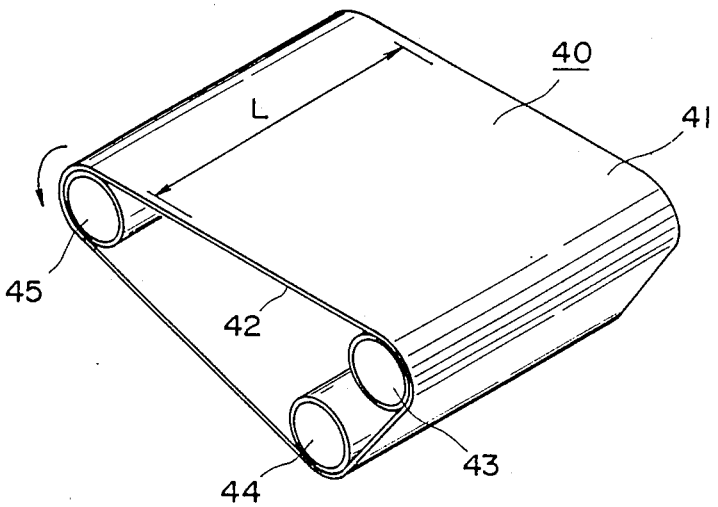
FIG. 15 is a perspective view of an example of an image bearing member in the form of a combination of a belt and supporting rollers.

FIG. 15 illustrates an example of a photosensitive belt and drums supporting it. In this Figure, an electrophotographic photosensitive belt 40 comprises an electrically conductive base belt 42 of a metal and a photoconductive surface layer 41 thereon. The photosensitive belt 40 is supported around the supporting drums 43, 44 and 45 of a conductive material such as aluminum and stainless steel. At least one of those drums may have the same structure as in FIG. 1, FIG. 11, FIG. 13 or FIG. 14, in which case the drum functions as a driving drum, and the other drums function as follower drums. By doing so, the photosensitive belt 40 is capable of being driven. In this case, the driving drum corresponds to the photosensitive drum 1 of the foregoing embodiments, and the positional relations described applies to this case. Similarly to the FIG. 1 embodiment, an electrically contacting plate can be disposed within a range of the width of the belt. Therefore, by disposing the contacting plate as well as the flange within the effective range of the photosensitive member, the width of the image bearing member can be minimized, allowing efficient utilization of the space.

As described above, according to the present invention, the peculiar positional relations described hereinbefore the possible eccentricity, deformation and/or vibration can be minimized even when the driving load is increased. Additionally, the portion of the image bearing member for receiving the driving force and/or positioning is disposed inside the image bearing member, so that the portion is hardly damaged or deformed externally, together with the advantage of the reduced width of the image bearing member.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to an image forming apparatus, comprising:

an image bearing drum including a conductive drum, an insulating flange provided at an open longitudinal end of the conductive drum and a conductive member, wherein the conductive member, in use of said process cartridge, is disposed between an inside surface of the conductive drum and a conductive portion of a rotational shaft for said image bearing drum to establish electrical connection between said image bearing drum and said image forming apparatus;

process means actable on said image bearing drum; and supporting member for integrally supporting said image bearing drum and said process means.

2. A cartridge according to claim 1, wherein said image bearing drum is an electrophotographic photosensitive drum.

3. A cartridge according to claim 1, wherein the shaft is a positioning pin fixed on said image forming apparatus to position a rotational axis of said image bearing drum.

4. A cartridge according to claim 1, wherein the conductive member is a plate-like member fixed on the insulating flange.

5. A cartridge according to claim 2, wherein said process means includes a charger, a developing device and cleaning means.

6. A process cartridge detachably mountable to an electrophotographic image forming apparatus, comprising:

an image bearing photosensitive drum including a conductive drum, an insulating flange provided at an open longitudinal end of the conductive drum and a conductive member, wherein the conductive member is disposed adjacent an inside of the insulating flange and wherein a part of the conductive member is contacted to an inside surface of the conductive drum, and another part thereof is, in use of said process cartridge in said image forming apparatus, contacted to a second conductive member for a rotational axis of the drum;

process means actable on said image bearing drum; and supporting member for integrally supporting said image bearing drum and said process means.

7. A cartridge according to claim 6, wherein the second conductive member is a positioning pin fixed on said image forming apparatus to position a rotational axis of said photosensitive drum.

8. A cartridge according to claim 6, wherein the first conductive member is fixed on the insulating flange.

9. A cartridge according to claim 6, wherein said process means includes a charger, a developing device and cleaning means.

10. A process cartridge detachably mountable to an electrophotographic image forming apparatus, comprising:

an image bearing photosensitive drum including a conductive drum, an insulating flange provided at an open longitudinal end of the conductive drum and a conductive member, the insulating flange being provided with an opening, wherein the conductive member is fixed on the insulating flange, and wherein a part of the conductive member is contacted to an inside surface of the conductive drum, and the other part thereof is faced to the opening of the insulating flange;

process means actable on said image bearing drum; and supporting member for integrally supporting said image bearing drum and said process means.

11. A cartridge according to claim 10, wherein a positioning pin, for said photosensitive drum, of said image forming apparatus is inserted into the opening of the insulating member when the cartridge is flange in said image forming apparatus.

12. A cartridge according to claim 11, wherein the positioning pin is fixed on said image forming apparatus and is slidably contactable to the conductive member.

13. A cartridge according to claim 10, wherein said process means includes a charger, a developing device and cleaning means.

14. A process cartridge detachably mountable to an electrophotographic image forming apparatus, comprising:

an image bearing photosensitive drum including a conductive drum, an insulating flange provided at an open longitudinal end of the conductive drum and mounted on an inside of the conductive drum and a conductive member fixed on the insulating flange, wherein the conductive member is disposed adjacent an inside of the insulating flange and wherein a part of the conductive member is formed into a projection to be contacted to an inside of the conductive drum, and the other part thereof is disposed at a rotational center of the drum of said cartridge;

process means actable on said image bearing drum; and supporting member for integrally supporting said image bearing drum and said process means.

15. A cartridge according to claim 14, wherein the conductive member is in sliding contact with a positioning pin, for said photosensitive drum, of said image forming apparatus, when said process cartridge is used in said image forming apparatus, the pin functioning as a rotational shaft.

16. A process cartridge detachable mountable to an electrophotographic image forming apparatus, comprising:

an image bearing photosensitive drum including a conductive drum, an insulating flange provided at an open longitudinal end of the conductive drum and mounted on an inside of the conductive drum and a plate-like conductive member fixed on the insulating flange, wherein the conductive member is disposed adjacent an inside of the insulating flange and wherein a part of the conductive member is formed into a projection to be contacted to an inside of the conductive drum, and the other part thereof is resilient and extended to a rotational center of said photosensitive drum;

process means actable on said image bearing drum; and supporting member for integrally supporting said image bearing drum and said process means.

17. A cartridge according to claim 16, wherein the conductive member is in sliding contact with a positioning pin, for said photosensitive drum, of said image forming apparatus, when said process cartridge is used in said image forming apparatus, the pin functioning as a rotational shaft.

18. A cartridge according to claim 16, wherein said process means includes a charger, a developing device and cleaning means.

* * * * *

UNITED STATES PATENT AND TRADEMARK OFFICE

CERTIFICATE OF CORRECTION

PATENT NO. : 4,975,744

DATED : December 4, 1990

INVENTOR(S) : Ebata, et al.

It is certified that error appears in the above-identified patent and that said Letters Patent is hereby corrected as shown below:

ON THE COVER

Item [56] U.S. PATENT DOCUMENTS

| | | | | |
|---|---|---|---|---|
| above | 4,345,834 | 8/1982 | Kimura, et al. ..... | 355/3 DR |
| insert | | | | |
| | --3,910,184 | 10/1975 | Springer ..... | 101/116 |
| | 4,326,793 | 4/1982 | Buholz ..... | 355/3 DR |
| | 4,327,992 | 5/1982 | Babicz ..... | 355/3 R-- |
| change | | | | |
| | 4,449,809 | 5/1985 | Tamura ..... | 353/3 DR |
| to | | | | |
| | 4,449,809 | 5/1984 | Tamura ..... | 355/3 DR |
| below | 4,561,763 | 12/1985 | Basch ..... | 355/3 DR |
| insert | | | | |
| | --4,575,221 | 3/1986 | Onodo et al. ..... | 355/3 R-- |

Item [56] FOREIGN PATENT DOCUMENTS

| | | | |
|---|---|---|---|
| below | 1490770 | 11/1977 | United Kingdom |
| insert | | | |
| | --2119105 | 9/1983 | United Kingdom-- |

UNITED STATES PATENT AND TRADEMARK OFFICE

CERTIFICATE OF CORRECTION

PATENT NO. : 4,975,744

DATED : December 4, 1990

INVENTOR(S) : Ebata, et al.

It is certified that error appears in the above-identified patent and that said Letters Patent is hereby corrected as shown below:

COLUMN 5:

Line 1, "transmissions," should read --transmissions,--.
Line 46, "tance 1," should read --tance,--.
Line 47, "in to" should read --into--.

COLUMN 7:

Line 9, "an" should read --and--.
Line 37, "out side" should read --outside--.

COLUMN 8:

Line 20, "drive." should read --driven.--.

COLUMN 10:

Line 6, "insulating member" should read --insulating flange--
and "flange" should read --mounted--.
Line 39, "detachable mountable" should read --detachably mountable--.

UNITED STATES PATENT AND TRADEMARK OFFICE

CERTIFICATE OF CORRECTION

PATENT NO. : 4,975,744

DATED : December 4, 1990

INVENTOR(S) : Ebata, et al.

It is certified that error appears in the above-identified patent and that said Letters Patent is hereby corrected as shown below:

Line 39, "detachable mountable" should read --detachably mountable--.

Signed and Sealed this

Sixth Day of July, 1993

Michael K. Kirk

MICHAEL K. KIRK

*Acting Commissioner of Patents and Trademarks*

*Attest:*

*Attesting Officer*